US006444935B1

(12) United States Patent
DeGraw

(10) Patent No.: US 6,444,935 B1
(45) Date of Patent: Sep. 3, 2002

(54) HIGH SPEED TRACK SHUTTER SYSTEM FOR SEMI-CONDUCTOR INSPECTION

(75) Inventor: Chris DeGraw, Burnsville, MN (US)

(73) Assignee: Electro Scientific Industries, Inc.

( * ) Notice: Subject to any disclaimer, the term of this patent is extended or adjusted under 35 U.S.C. 154(b) by 0 days.

(21) Appl. No.: 09/691,578

(22) Filed: Oct. 18, 2000

(51) Int. Cl.[7] ..... B07C 5/344
(52) U.S. Cl. ..... 209/573; 209/574; 209/682
(58) Field of Search ..... 209/573, 574, 209/626, 625, 627, 911, 680, 682, 656, 658

(56) References Cited

U.S. PATENT DOCUMENTS 3,603,646 A * 9/1971 Leoff ..... 406/89
4,049,123 A * 9/1977 Fegley et al. ..... 209/555
4,222,488 A * 9/1980 Jones et al. ..... 209/583
4,323,184 A * 4/1982 Maurer ..... 227/120
4,503,807 A * 3/1985 Nakayama et al. ..... 118/719
4,604,020 A * 8/1986 Toro Lira et al. ..... 414/217
4,867,296 A * 9/1989 Volna ..... 198/345.3
4,976,356 A * 12/1990 Mizuno et al. ..... 209/539
5,184,068 A * 2/1993 Twigg et al. ..... 324/755
5,226,361 A * 7/1993 Grant et al. ..... 101/44
6,036,582 A * 3/2000 Aizawa et al. ..... 451/41

* cited by examiner

*Primary Examiner*—Donald P. Walsh
*Assistant Examiner*—Joseph Rodriguez
(74) *Attorney, Agent, or Firm*—Young & Basile

(57) ABSTRACT

The present invention provides a shutter system for use with an automated semiconductor chip handling device. The semiconductor chip handling device includes a track down which semiconductor chips travel. Reliefs are positioned on the track to prevent the semiconductor chips from escaping. A gap in the relief provides access to the semiconductor chips so that they may be removed from the track. A pair of shutters pivot between a first position where they cover the gap and a second position where the gap is uncovered so that chips may be removed from the gap without chips escaping from the track during normal operation.

8 Claims, 2 Drawing Sheets

HIGH SPEED TRACK SHUTTER SYSTEM FOR SEMI-CONDUCTOR INSPECTION

FIELD OF THE INVENTION

The present invention relates to the automated handling of semiconductor chips.

BACKGROUND OF THE INVENTION

The prior art provides for integrated circuit chip mark and lead inspecting handling equipment which performs a variety of inspections on integrated circuit chips. These inspections include mark and coplanarity lead inspection. FIG. 1 illustrates a semi-conductor automation inspection device 10. The device includes inspection equipment 12 and a monitor 14. Integrated circuit chips are inspected by inspection system 12 and the results are reported on monitor 14. After the chips are inspected they are fed via gravity down inclined track 20 where they are packaged in a medium defined by a customer.

Typically packages include a tape 16 or a tube (not shown). Tape 16 is typically a pocketed strip onto which semiconductor chips are placed. Semiconductor chip customers may purchase chips on a roll of tape. In the event the chips are placed onto a tape medium the chips are removed from track 20 and placed into the pockets of tape 16 as is well known in the art. If a tube is used the chips simply slide via gravity into the tube positioned at location 18.

The performance of semi-conductor automation inspection equipment is measured in units of chips inspected per hour (UPH). In an effort to improve UPH the chips moving down track 20 have been accelerated using compressed air. The use of compressed air, however, occasionally results in chips flying off of track 20 which is unacceptable for obvious reasons.

SUMMARY OF THE INVENTION

The present invention provides a shutter system positioned on a track of an automated semiconductor handling device. The automated semiconductor handling device includes an inspection station operative to inspect a plurality of semiconductor chips and an inclined track down which the semiconductor chips travel. The semiconductor handling device is operative in removing semiconductor chips rejected at the inspection station, and delivering acceptable semiconductor chips to a storage medium. The semiconductor handling device further includes a relief positioned substantially continuously along the inclined track, the relief is operative in preventing the semiconductor chips from disengaging from the inclined track with the relief including at least one gap where the semiconductor chips are not prevented from disengaging from the track. At least one shutter is positioned to selectively cover the gap in the relief such that when the shutter is covering the gap the shutter prevents the semiconductor chips from disengaging from the track. When the shutter is not covering the gap the automated semiconductor handling device may remove semiconductor chips from the track.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

The present invention provides an automated semiconductor handling device which inspects semiconductor chips whereby the semiconductor chips travel on an inclined track and are retained on the inclined track by a relief. A gap in the relief is provided to provide the semiconductor handling device with access to the semiconductor chips so that semiconductor chips may be removed from the track. It is understood that semiconductor chips may need to be removed if they are rejected, or if they are to be stored on a tape storage medium. The gap is selectively covered and uncovered by a shutter to provide the automated semiconductor handling device access to the semiconductor chips so that they may be removed from the track. Thus, by using the shutter system of the present invention, chips may be captured on the track at all times, and may be removed only when it is desired.

With reference to the figures where unlike elements are shown alike the environment of the present invention as well as the present invention are illustrated.

Figure 1:
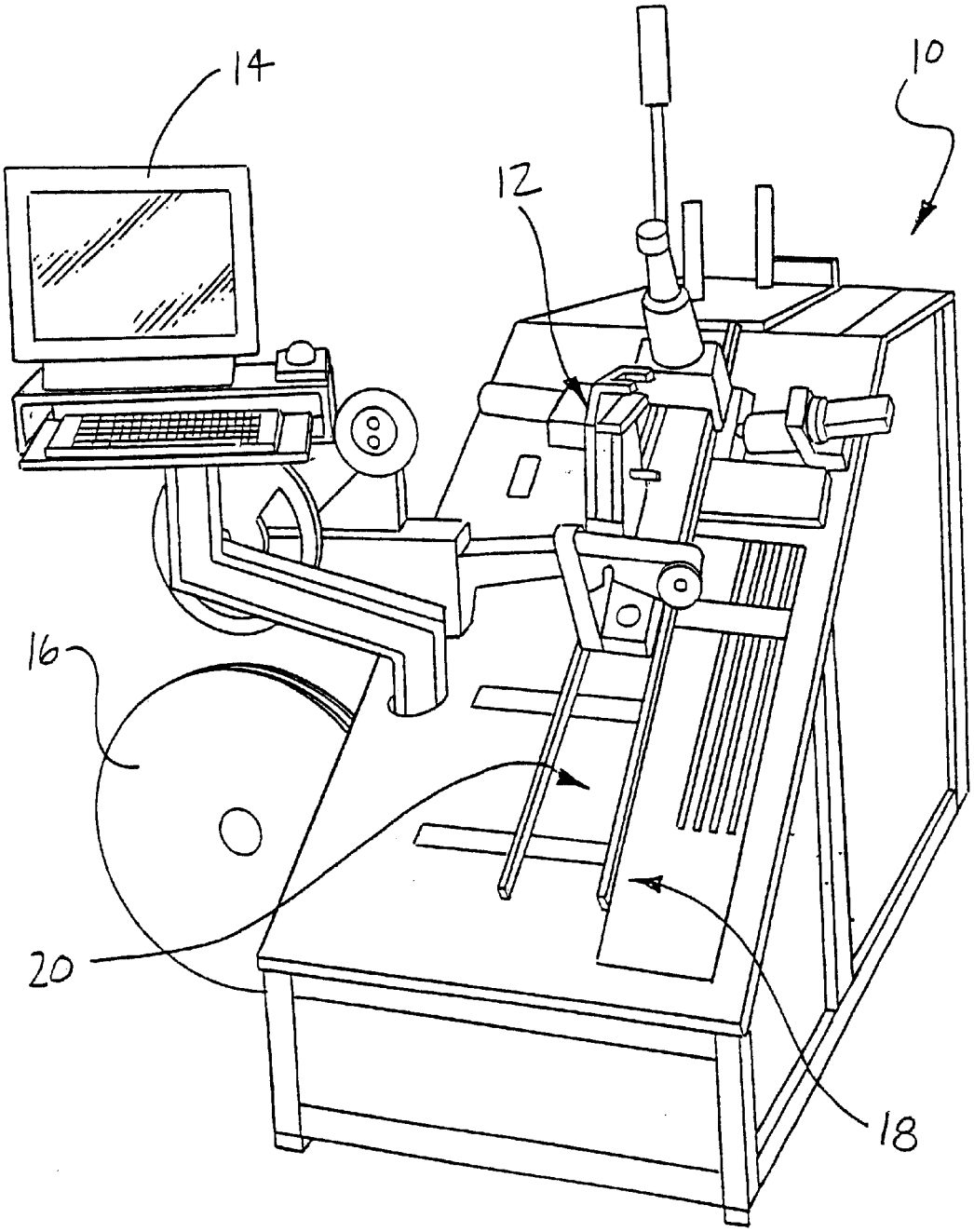
FIG - 1 PRIOR ART
FIG. 1 illustrates a semi-conductor automation and inspection machine.

FIG. 1 illustrates a semi-conductor automation and inspection device. The semi-conductor automation and inspection device is controlled by a control system and includes inspection equipment 12 according to known principles in the art. Integrated circuit chips are conveyed on a track 20 underneath inspection equipment 12 where they are inspected. Integrated circuit chips then slide down track 20 where rejected chips are removed and/or where chips to be stored in a tape medium are removed for placement into the tape medium.

Figure 2:
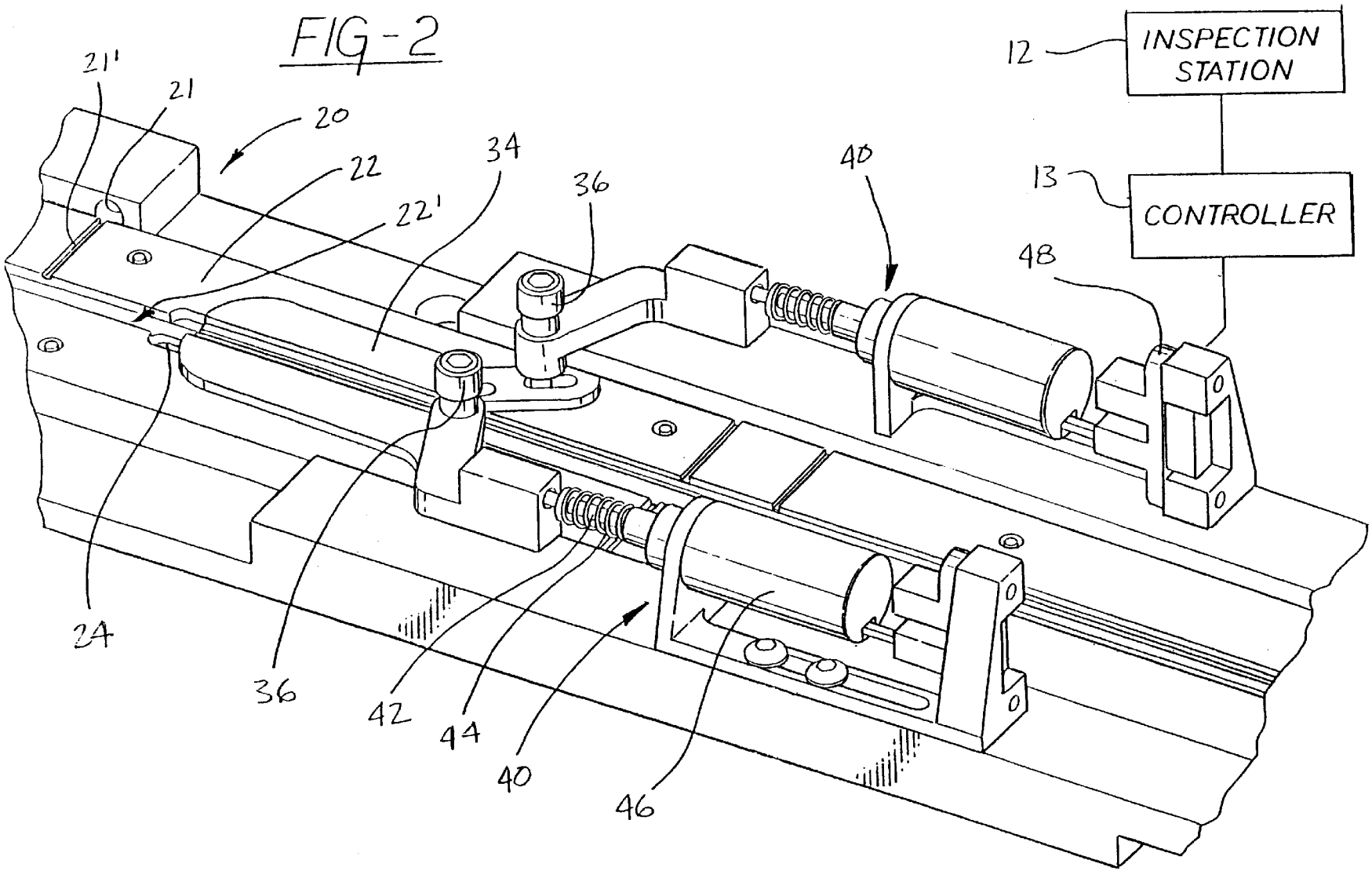
FIG. 2 is a perspective view of the shutter system according to a first aspect of the present invention.

With reference to FIG. 2 there is shown a perspective view of the first preferred embodiment of the present invention. FIG. 2 illustrates track 20. Track 20 includes a rail 22 and relief sections 22' which function to prevent the semiconductor chips from disengaging from track 20 as they slide down track 20. Relief 22' is preferably a pair of flanges positioned over the track thereby capturing the chips. Track 20 includes compressed air portholes 21 which force compressed air down tracks 21' to accelerate the semiconductor chips and increase UPH. A gap in rail 22 and relief 22' is provided at 24 which provides the automated semiconductor inspection device access to the chips so that they may be removed if circumstances dictate.

As shown in the first preferred embodiment, a pair of shutters or paddles 34 selectively cover gap 24 so as to retain chips on track 20 as required. Shutters 34 are pivotally mounted by pins 36 adjacent to track 20 and shutters 34 are actuated by solenoid system 40. As illustrated, solenoid system is operatively connected to inspection station 12 through controller 13. Solenoid system 40 includes a solenoid 46 having a shaft 42 around which a compression spring 44 is positioned. In operation, compression spring 44 biases shutters 34 in their closed position and, upon actuation of solenoid 46, shutters 34 pivot about their axis at pins 36 to open. It is understood that alternate mechanisms could be used to selectively cover and uncover gap 24 to provide access to the semiconductor chips. For example, a single shutter could be used, or a non-pivoting slide bar could be positioned to linearly cover and uncover gap 24.

In the first preferred embodiment shaft 42 is tapered to accommodate compression spring 44. Compression spring 44 biases shutters 34 to cover gap 24. Shaft 42 also has an increased length so as to trip a sensor 48 when the solenoid 46 is active.

Sensor 48 is operatively connected to controller 13 and allows the semiconductor and automation inspection device 10 to have information as to the location of shutters 34. It is important to know that the shutters are open in cases where chips are removed from the tracks so as to prevent unnecessary damage. Sensors 48 are available from a wide variety of well known sources, including but not limited to Honeywell.

In systems where the semi-conductor chips are being stored in a tube medium, shutters 34 will only be opened to remove rejected chips. These rejected chips are removed as they travel down track 20 according to known principles in the art. Shutters 34 remain in their closed position for chips which pass inspection, and such chips continue down track 20 and slide into a tube.

In an instance where the customer requirement is that the circuit chips are stored on tape 16 shutters 34 are opened for each chip. The chip is then placed on the tape or rejected according to known principles in the art.

In operation a user would select either a tube storage or tape storage. Chips would be inspected by inspection equipment 12 and the results of each inspection would be conveyed to controller 13 of the automated semiconductor handling device. Controller 13 would then instruct solenoid system 40 to selectively uncover gap 24 as appropriate and controller 13 would direct device 10 to remove the chip.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An automated semiconductor handling device including an inspection station operative to inspect a plurality of semiconductor chips and an inclined track down which the semiconductor chips travel, the semiconductor handling device operative in removing semiconductor chips rejected at the inspection station, and delivering acceptable semiconductor chips to a storage medium, the automated semiconductor handling device comprising:

at least one elongated rail positioned substantially continuously along the inclined track, wherein the semiconductor chips are positioned beneath the rail to prevent the semiconductor chips from disengaging from the inclined track, the rail including at least one gap in the rail where the semiconductor chips are not substantially underneath the rail wherein the semiconductor chips are not prevented from disengaging from the track;

at least one shutter positioned to selectively cover the gap in the rail such that when the shutter is covering the gap, the shutter is co-linear with the rail and the shutter prevents the semiconductor chips from disengaging from the track, and when the shutter is not covering the gap the automated semiconductor handling device may remove semiconductor chips from the track.

2. An automated semiconductor handling device as in claim 1 wherein the shutter uncovers the gap so that rejected semiconductor chips may be removed from the track.

3. An automated semiconductor handling device as in claim 2 where the storage medium is a tape and the shutter uncovers the gap so that semiconductor chips may be placed on the tape.

4. An automated semiconductor handling device as in claim 3 including a pair of shutters which cooperate to selectively uncover the gap, the shutters being pivotally movable and actuated by a solenoid.

5. An automated semiconductor handling device as in claim 4 wherein the shutters are biased to cover the gap.

6. An automated semiconductor handling system where the automated semiconductor handling system includes a track on which semiconductor chips travel with the assistance of compressed air, the automated semiconductor handling system comprising:

a pair of elongated rails, the semiconductor chips positioned under the rail to prevent the semiconductor chips from disengaging from the track, each rail having a gap where the semiconductor chips are not substantially under the rail wherein semiconductor chips may disengage from the track;

a pair of shutters pivotally mounted on the semiconductor handling device, each shutter being proximate to one of the gaps, the shutters pivotally movable between a first position where the shutters cover one of the gaps with the shutter-being co-linear with one of the rails and a second position where the shutters do not cover the gap, and;

means for moving the shutters between their first and second positions.

7. An automated semiconductor handling system as in claim 6 wherein the shutters are biased to their first position by compression spring.

8. An automated semiconductor handling system as in claim 7 further comprising a sensor which detects whether the shutters are in their first or second positions.

* * * * *